United States Patent [19]

Boik

[11] Patent Number: 4,560,076

[45] Date of Patent: Dec. 24, 1985

[54] TAMPER INDICATING BAND FOR USE IN LOW RISE CAM-OFF APPLICATION

[75] Inventor: Elmer J. Boik, Lombard, Ill.

[73] Assignee: Continental White Cap, Inc., Northbrook, Ill.

[21] Appl. No.: 601,209

[22] Filed: Apr. 17, 1984

[51] Int. Cl.[4] ..... B65D 41/34

[52] U.S. Cl. ..... 215/252; 215/253

[58] Field of Search ..... 215/252, 253, 258

[56] References Cited

U.S. PATENT DOCUMENTS

| | | | |
|---|---|---|---|
| 2,423,582 | 7/1947 | Coleman | 215/252 |
| 3,314,564 | 4/1967 | Andersen et al. | 215/252 |
| 3,455,478 | 7/1969 | Fields et al. | 215/252 |
| 3,484,012 | 12/1969 | White et al. | 215/252 |
| 3,866,782 | 2/1975 | Westfall | 215/253 |
| 4,156,490 | 5/1979 | Peraboni | 215/252 |
| 4,494,664 | 1/1985 | Guala | 215/252 |

FOREIGN PATENT DOCUMENTS

| | | | |
|---|---|---|---|
| 1536459 | 7/1968 | France | 215/252 |

*Primary Examiner*—Steven M. Pollard
*Attorney, Agent, or Firm*—Charles E. Brown

[57] ABSTRACT

This relates to a closure having incorporated therein tamper indicating mechanism. The closure is provided with a tamper indicating member in the form of a sleeve which is divided into upper and lower bands which are separate from one another except for rupturable bridges. In lieu of relying solely upon the axial movement of the unrestrained part of the tamper indicating member to effect rupture of the bridges, the tamper indicating member has formed thereon lugs which cooperate with lugs on the neck finish and which lugs have camming surfaces to force the lower band axially away from the upper band as the closure unit is rotated in a removal operation. Separation of the bands may also be assisted by cooperating ramp surfaces between the two bands which become operative when the upper band is rotated and the lower band is held against rotation. This abstract is not to be construed as limiting the claims of the application.

9 Claims, 11 Drawing Figures

FIG.6
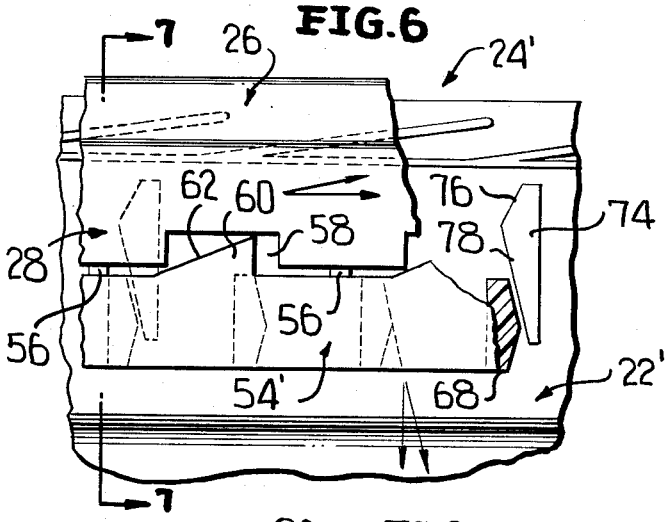
FIG.7
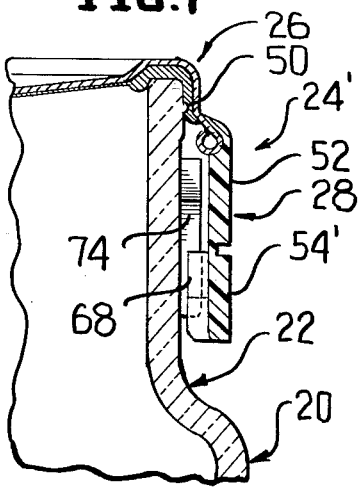
FIG.8
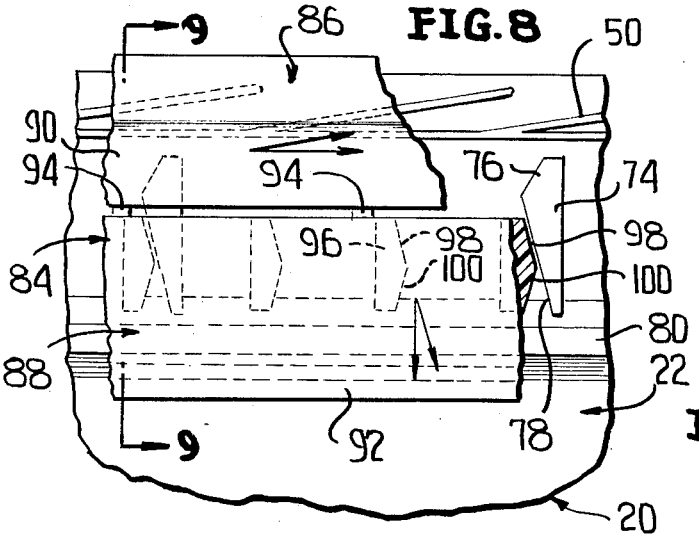
FIG.9
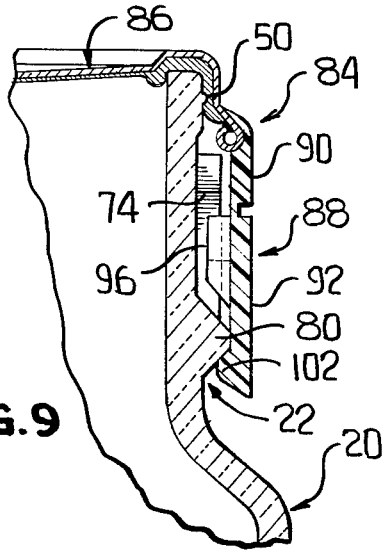
FIG.10
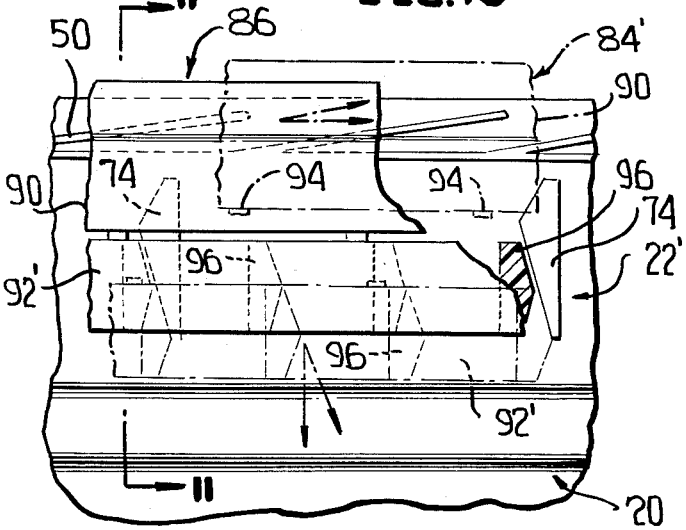
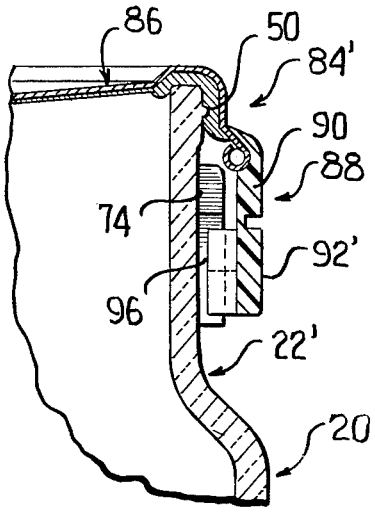
FIG.11

TAMPER INDICATING BAND FOR USE IN LOW RISE CAM-OFF APPLICATION

This invention relates in general to new and useful improvements in closures, and more particularly to a closure having a tamper indicating band which is attached to the main closure body and wherein, during the opening of an associated container by removing the main closure body, the tamper indicating band is detached from the main closure body.

Normally a tamper indicating closure is in the form of a conventional closure having attached to the skirt thereof by way of circumferentially spaced bridges a tamper-band which is anchored to the container neck finish and which remains attached to the container when the closure is removed. Difficulties have been encountered in assuring the breakage of the bridges in that the bridges tend to elongate before actual fracture takes place. Thus, unless there is considerable axial movement of the closure relative to the container, there may be insufficient movement of the main closure body relative to the tamper-band to effect rupture of the bridges.

In accordance with this invention, in lieu of merely anchoring the tamper-band, the closure, including the tamper-band, is so related to the container wherein during the rotational removal of the closure there are camming means which effect an axial separation of the tamper-band relative to the closure other than that which would be provided by the threaded engagement of the closure with respect to the container.

In the simplest form of the invention, the tamper indicating member is in the form of a sleeve which includes an upper band and a lower band, the two hands being connected together by circumferentially spaced, axially extending bridges, and the lower band being the tamper-band. In one form of the invention, the tamper-band is provided with locking means for engagement by stop means formed on the neck finish with there being cooperating cam surfaces which force the tamper-band axially downwardly when the closure is rotated so as to effect separation of the tamper-band from the closure by movement of both the closure and the tamper-band in axial but opposite directions.

The engagement between the locking means of the tamper-band and the stop means of the container neck finish also prevents rotation of the tamper-band so as to facilitate the relative movement of the closure with respect to the tamper-band.

When it is desired that the tamper band remain permanently attached to the container, the tamper-band and the neck finish will be provided with cooperating abutments.

In another embodiment of the invention, the tamper indicating member is in the form of two bands which are joined together by the bridges, but wherein one of the bands is provided with a notch opening toward the other of the bands and the other of the bands has a projection with a ramp which extends into the notch and wherein, when the band attached to the closure is rotated and the other of the two bands is held stationary against rotation by locking engagement with the container neck finish, the ramp construction will effect a cammed axial relative movement of the bands which will effect rupture of the bridges.

In this further embodiment of the invention, the means for preventing rotation of the tamper-band may be the same as the locking means and cooperating stop means discussed hereinabove so as further to effect separation of the two bands.

The band arrangement employing the ramp construction for separation of the bands may be selectively provided with means for locking the tamper-band to the container neck finish for permanent retention of the tamper-band on the neck finish.

With the above and other objects in view that will hereinafter appear, the nature of the invention will be more clearly understood by reference to the following detailed description, the appended claims, and the several views illustrated in the accompanying drawings.

IN THE DRAWINGS

FIG. 6 is a fragmentary elevational view similar to FIG. 3, and shows a modified form of the invention wherein means for retaining the tamper-band on the container have been eliminated.

FIG. 7 is an enlarged fragmentary sectional view taken generally along the line 7—7 of FIG. 6, and shows generally the constructional details of the closure and its relationship to the container neck finish.

FIG. 8 is an enlarged fragmentary elevational view with parts broken away similar to FIG. 3, and shows a modified form of closure to tamper-band arrangement.

FIG. 9 is an enlarged fragmentary sectional view taken generally along the line 9—9 of FIG. 8, and shows the constructional details of the closure and tamper-band.

FIG. 10 is yet another fragmentary elevational view of a further form of the invention.

FIG. 11 is a fragmentary vertical sectional view taken generally along the line 11—11 of FIG. 10, and shows the constructional details of the closure.

Figure 1:
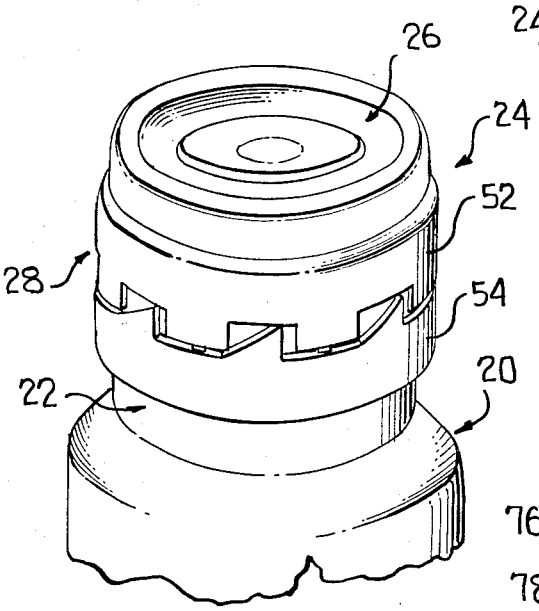
FIG. 1 is a fragmentary top respective view of a tamper indicating closure formed in accordance with this invention, and shows the same applied to a container.

Referring now to the drawings in detail, it will be seen that there is illustrated in FIGS. 1–5 one embodiment of the invention. In these figures there is illustrated a container 20 having a neck finish 22 to which there is removably attached a closure unit identified by the numeral 24. In the illustrated embodiment of the invention, the closure unit 24 includes a closure member 26 and a tamper indicating member 28.

The closure member 26 includes a metal shell 30 which is configurated to include an end panel 32 joined by a corner portion 34 to a skirt 36 which terminates in a radially inwardly directed curl 38. The corner 34 is so configurated as to define a channel 40 in which a band of sealant or gasket material 42 is placed.

The neck finish 22 is provided at the extreme upper end thereof with an end sealing surface 44 which engages the gasket material 42 and forms a seal therewith.

It is to be noted that the gasket 42 has a portion 46 which extends within the skirt 36 and which opposes a peripheral outer surface 48 of the neck finish 22 adjacent the upper end thereof. The surface 48 has projecting radially outwardly therefrom a plurality of thread segments 50.

Figure 2:
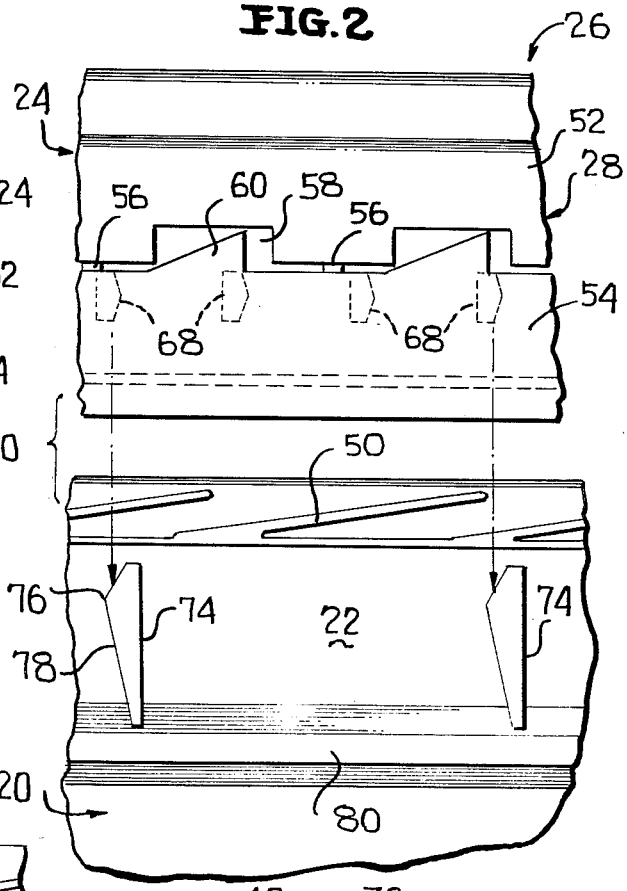
FIG. 2 is an enlarged fragmentary exploded elevational view showing the closure and the container neck finish prior to assembly of the closure with the container.
Figure 3:
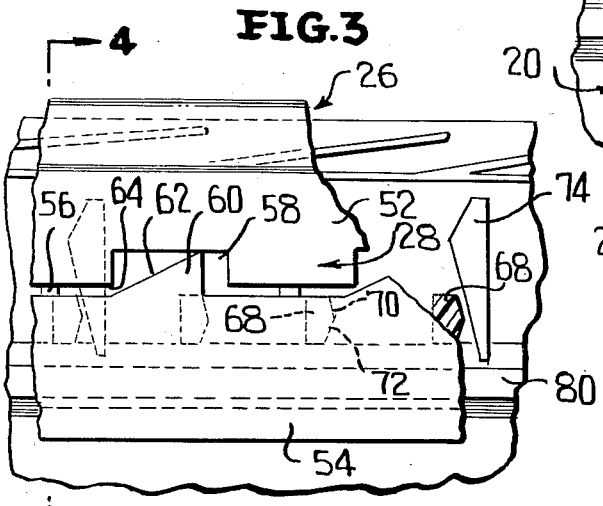
FIG. 3 is an enlarged fragmentary elevational view with parts broken away, showing the closure applied to a container.

It is to be understood that the closure unit 24 is of the press-on/screw-off type and that after the closure unit 24 has been applied the gasket or compound portion 46 will flow around the thread segments 50 and form an interlock therewith so that the closure unit 24 may be removed by rotation. As is best shown in FIG. 2, the thread segments 50 are relatively short and have only a minor slope so that the closure unit 24 is released from the thread segments 50 before there is any appreciable axial movement of the closure unit with respect to the container neck finish.

In accordance with this invention the closure unit 24 has attached to the curl 38 thereof an upper part of the tamper indicating member 28. On the other hand, it is feasible that the shell 30 and the tamper indicating member 28 be integrally formed.

It will be seen that the tamper indicating member 28 is in the form of a sleeve which is initially divided into two bands including an upper band 52 and a lower band 54, with the lower band 54 being the tamper-band. The bands 52, 54 are integrally formed and are separate from one another except for a plurality of circumferentially spaced connecting bridges 56.

It is to be noted that the lower part of the upper band 52 is provided at circumferentially spaced intervals with notches 58 which open toward the lower band 54. Within each of the notches 58 there is a projection 60 integrally formed with the lower band 54. Each projection 60 includes a ramp 62 with which a lower corner portion 64 of an adjacent part of the band 52 will be engaged.

In order that the tamper indicating member 28 may properly function, it is necessary that the lower band 54 be restrained against rotation with the upper band 52. In order to accomplish this, the lower band 54 has on its radially inner surface a plurality of projecting lugs 68. Each lug 68 functions as locking means and includes an upper cam surface 70 and a lower cam surface 72.

As is best shown in FIG. 2, the neck finish 22 is provided with stop means 74 in the form of projecting lugs which are circumferentially spaced and which include an upper cam surface 76 and a lower cam surface 78.

It will also be seen that the neck finish 22 includes an annular bead 80 which is disposed below the lugs 74 and beneath which there is engaged a retaining bead 82 integrally formed with the radially inner surface of the lower band 54.

Figure 4:
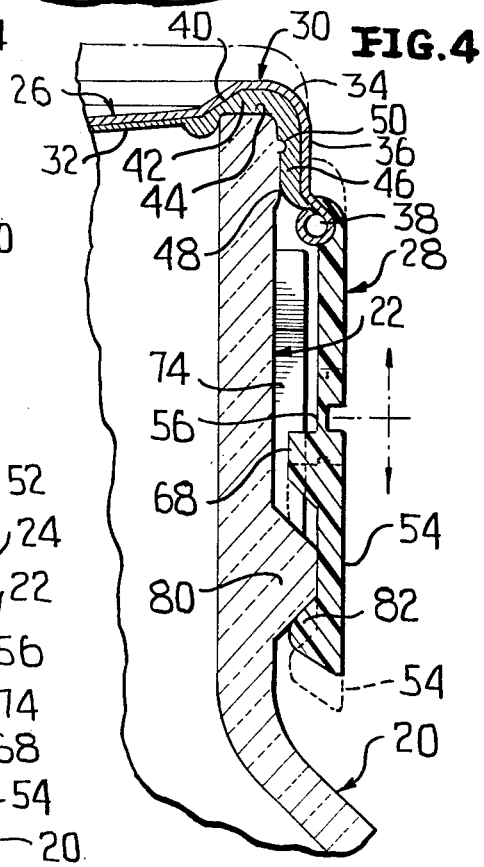
FIG. 4 is an enlarged fragmentary vertical sectional view taken generally along the line 4—4 of FIG. 3, and shows the specifics of the closure and the tamper-band and the relationship thereof with respect to the container neck finish.

When the closure unit 24 is first applied to the neck finish 22, the bead 28 snaps over the bead 80 and serves to hold the closure unit 24 in sealed engagement with the neck finish 22 in the manner best shown in FIG. 4. The interlocking beads 80, 82 thus initially hold the closure uniot 24 in place on the closure until the gasket material 42 has set.

Referring now to FIG. 2 in particular, it will be seen that the closure unit 24 is applied by pressing it onto the neck finish 22 as is shown in FIG. 2. The lugs 68 are displaced relative to the lugs 74 by engagement of the cam surface 72 with the cam surface 76.

Figure 5:
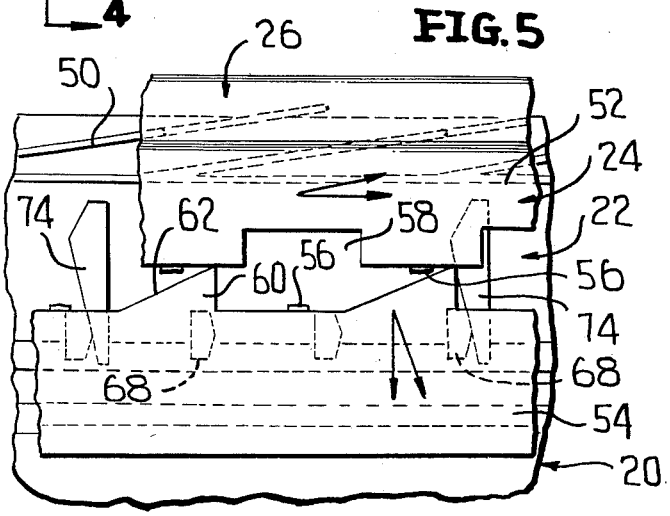
FIG. 5 is a fragmentary view similar to FIG. 3, and shows the closure rotated toward open position and the tamper-band separated from the remainder of the closure.

When it is desired to open the container 20, the closure unit 24 is rotated in a counterclockwise direction with the thread segments 50 urging the closure unit 24 axially upwardly. At the same time, after the lugs 68 come into engagement with the lugs 74, the cooperating cam surfaces 70, 78 serve both to restrict rotation of the lower band 54 and to force the lower band 54 axially downwardly away from the upper band 52, thereby placing a rupturing force on the bridges 56. Since the bridges 56 have a tendency to elongate, as the upper band 52 is continued to be rotated, there will be an elongation of the bridges 56 with the corner 64 engaging a respective ramp surface 62 so as to urge the upper band 52 axially away from the lower band 54. The net result is the breakage with ease, of the bridges 56 and the release of the lower band 54 from the upper band 52, as shown in FIG. 5.

The lower band 54 remains attached to the container neck finish 22 by its engagement beneath the bead 80 as is shown in FIG. 4.

Referring now to FIGS. 6 and 7, it will be seen that there is illustrated a slightly modified form of the invention which, except for two omissions, is identical to the embodiment shown in FIGS. 1–5. The container is provided with a modified neck finish 22' and the closure unit is identified by the numeral 24'. The difference between the embodiment of the invention of FIGS. 6 and 7 and the embodiment of FIGS. 1–5 is that the neck finish 22' does not incorporate a bead corresponding to the bead 80. In a like manner, the lower band, which is identified by the numeral 54', does not incorporate a bead corresponding to the bead 82.

The closure unit 24' cooperates with the neck finish 22' in all other aspects as described with respect to the closure unit 24 and the neck finish 22 of FIGS. 1–5.

Referring now to FIGS. 8 and 9, it will be seen that there is illustrated a modified form of the closure unit generally identified by the numeral 84. The closure unit 84 incorporates a closure panel 86 which carries a tamper indicating member 58. The closure unit 84 is of a configuration to cooperate with the above described container 20 having a neck finish 22.

The tamper indicating member 88 includes an uppeer band 90 and a lower band 92 which are axially spaced from one another and which are initially connected together by circumferentially spaced axially extending bridges 94. As in the case of the bridges 56, it is intended that when the closure unit 84 is removed from the neck finish 22 the bridges 94 will rupture to give evidence of tampering.

The upper band 90 is identical to the upper band 52 of the tamper indicating member 28 except that the notches 58 have been eliminated. In a like manner, the lowr band 92 is identical to the band 54 except that the projections 60 have been eliminated. On the other hand, the band 92 is provided on its radially inner surface with a plurality of circumferentially spaced, radially projecting lugs 96. The lugs 96 differ from the lugs 68 only as to their size, and each lug includes an upper camming surface 98 and a lower camming surface 100. The camming surfaces 98, 100 cooperate with camming surfaces 76 and 78 of the stop members 74 on the theck finish.

It is also to be noted that the closure panel 86 is identical to the closure panel 26.

In the removal of the closure unit 84, the separation of the lower band 92 from the upper band 90 is primarily due to the camming engagement of the surface 98 of each lug 100 with the surface 78 of each stop member 74. Thus, as the closure unit 84 is rotated to remove the closure unit, the upper band 90 moves upwardly due to the engagement of the closure panel with the interrupted threads 50 and the lower band 92 is forced downwardly by the coacting camming surfaces. In this manner, a slight rise of the upper band 90 is permitted since the total movement of the bands 90 and 92 apart is more than sufficient to effect assured rupture of the bridges 94.

In the embodiment of FIGS. 8 and 9 the lower band 90 is provided adjacent the lower edge thereof and on the radially inner surface thereof with a retaining bead 102 which engages behind the retaining bead 80 on the neck finish. In the embodiment of FIGS. 10 and 11, there is the modified neck finish 22' and the closure unit is identified by the numeral 84'. The closure unit 84' differs from the closure unit 84 only in the construction of the lower band 92' which differs from the lower band 92 by the omission of the retaining bead 102. Of course, as described above with respect to FIGS. 6 and 7, the neck finish 22' does not incorporate the equivalent of the retaining bead 80.

In the embodiments of FIGS. 1–5 and 8–9, the lower bands 54 and 92 are retained on the container so as to prevent littering by discarding the bands. On the other hand, if littering is not considerred a problem, since the retaining beds are not required for the rupture of the bridges 56 or 94, the released lower bands 54' and 92' need not be retained on the container, and therefore the retaining beads 80, 82 and 102 are not required.

It will be readily apparent from the foregoing description of the invention that rupture of the bridges is not effected solely by upward movement of the upper band of the tamper indicating member due to the axial feeding of the closure units by the threads on the container neck finish, but that the lower band, in each instance, is cammed downwardly as the closure unit is rotated.

Although only several preferred embodiments of the invention have been specifically illustrated and described herein, it is to be understood that minor variations may be made in the closure unit and more particularly in the tamper indicating member without departing from the spirit and scope of the invention as defined by the appended claims.

I claim:

1. A tamper indicating member for use with a closure removable by turning, said tamper indicating member in its as formed state being generally in the form of a sleeve and comprising an upper band and a lower band, rupturable bridges extending axially between and releasably interconnecting said upper band and said lower band, and means on said upper band and said lower band for axially separating said bands in response to rotation of said bands, said means including said upper band having securing means for attaching said upper band to a closure for rotation with the closure and said lower band having locking means for locking said lower and relative to a container to resist rotation of said lower band with said upper band when said upper hand is rotated, said locking means being in the form of a plurality of circumferentially spaced radially inwardly directed lugs formed on a radially inner surface of said lower band spaced above a lower end of said lower band, and each of said lugs having a circumferentially facing cam surface for urging said lower band axially away from said upper band in response to a rotary force in a closure releasing direction on said lower band.

2. A tamper indicating member according to claim 1 together with a retaining bead on said lower band for permanently retaining said lower band on a container, said retaining bead being separate and apart from said locking means.

3. A tamper indicating member according to claim 1 wherein each of said lugs has two of said circumferentially facing cam surfaces arranged axially one above the other, an upper one of said cam surfaces being operable to force said lower band axially away from said upper hand, and a lower one of said cam surfaces forming means for circumferentially positioning said lugs.

4. A tamper indicating member for use with a closure removable by turning, said tamper indicating member being generally in the form of a sleeve and comprising an upper band and a lower band, rupturable bridges extending axially between and releasably interconnecting said upper band and said lower band, and means on said upper band and said lower band for axially separating said bands and rupturing said bridges in response to relative rotation of said bands, said means including said upper band having securing means for attaching said upper band to a closure for rotation with the closure and said lower band having locking means for locking said lower band relative to a container to resist rotation of said lower band with said upper band when said upper band is rotated, together with a closure and a container neck finish, said closure having a sealed screw threaded connection with said neck finish, said tamper indicating member being coupled to said closure for rotation therewith, and said neck finish having stop means for engagement by said locking means, said locking means and said stop means having cooperable cam surfaces for urging said lower band axially downwardly in response to rotation of said lower band relative to said container neck finish, said lower band and said container neck finish having cooperating means disposed axially below and being separate and apart from said locking means and said stop means for retaining said lower band on said container neck finish after said closure and said upper band have been removed.

5. A tamper indicating member and closure and container neck finish assembly according to claim 4 wherein said closure and said tamper indicating means are of the press-on type and said locking means and said stop means have second coooperable cam surfaces for assuring movement of said locking means axially into overlapping relation to said stop means.

6. A tamper indicating member and closure and container neck finish assembly according to claim 4 wherein said stop means are in the form of axially extending and circumferentially spaced ribs projecting radially outwardly from said neck finish.

7. A tamper indicating member and closure and container neck finish assembly according to claim 6 wherein each of said ribs has an upper cam surface for engagement by said locking means for assuring movement of said locking means axially into overlapping relation witn said stop means when said closure and said tamper indicating member are applied.

8. A tamper indicating member and closure and container neck finish assembly according to claim 7 wherein each of said ribs also has a lower cam for engagement by said locking means during removal of said closure.

9. A tamper indicating member and closure and container neck finish assembly according to claim 8 wherein said locking means includes circumferentially spaced lugs, and each of said lugs has an upper cam surface for engaging a respective rib lower cam surface and a lower cam surface for engaging a respective rib upper cam surface.

* * * * *